United States Patent [19]

Palazzolo

[11] 4,346,980

[45] Aug. 31, 1982

[54] SILVER RECOVERY SYSTEM FOR X-RAY AND PHOTOGRAPHIC FILM PROCESSORS

[76] Inventor: James C. Palazzolo, 3605 E. Monza Dr., Salt Lake City, Utah 84119

[21] Appl. No.: 115,210

[22] Filed: Jan. 25, 1980

[51] Int. Cl.[3] ..... G03D 3/06

[52] U.S. Cl. ..... 354/322; 354/324; 134/109; 204/109

[58] Field of Search ..... 354/319, 320, 321, 322, 354/324; 134/109, 110, 10; 204/109

[56] References Cited

U.S. PATENT DOCUMENTS

| | | | |
|---|---|---|---|
| 3,715,291 | 2/1973 | Bentley | 204/109 |
| 3,995,298 | 11/1976 | Vandeputte et al. | 354/324 |
| 4,042,473 | 8/1977 | Lindgren | 204/109 |
| 4,069,127 | 1/1978 | Salemi et al. | 204/109 |
| 4,078,983 | 3/1978 | Higgins | 204/109 |
| 4,081,816 | 3/1978 | Geyken et al. | 204/109 |
| 4,127,465 | 11/1978 | Higgins | 204/109 |
| 4,139,431 | 2/1979 | Scheidegger et al. | 204/109 |

*Primary Examiner*—L. T. Hix
*Assistant Examiner*—Alan Mathews
*Attorney, Agent, or Firm*—Trask & Britt

[57] ABSTRACT

An improved silver recovery system for automated X-ray film processors is disclosed. The fixer solution tank of an automated X-ray film processor is connected by overflow conduit and bottom discharge conduit to a surge-drip tank which is interconnected by a bottom orifice discharge and an overflow to a removable silver recovery unit. A high flow-rate pump interconnects the fixer solution tank with a fixer storage tank for rapid refilling upon complete discharge of the fixer from the fixer tank. Occasional emptying of the fixer tank is required for repairs and the like. More frequent emptying of the fixer tank is desired to enable more complete recovery of silver.

9 Claims, 3 Drawing Figures

SILVER RECOVERY SYSTEM FOR X-RAY AND PHOTOGRAPHIC FILM PROCESSORS

BACKGROUND OF THE INVENTION

1. Field

This invention relates to silver recovery systems for the recovery of the silver values from solutions used in the development of silver containing films such as X-rays, photographic, graphic arts and the like by automatic processing machines.

2. Prior Art

Processing of silver-containing films results in substantial amounts of silver being removed from the films. In some black and white films as much as 60% to 80% of the silver is dissolved from the film while in most color films substantially all the silver is removed. Recovery of this silver has become imperative for economical film processing. The silver values derived from x-ray films and the like during automatic processing have been heretofore collected as shown in FIG. 1 which illustrates a somewhat typical prior art apparatus wherein an overflow is provided from the fixer solution tank to a replaceable or removable silver recovery unit. Such silver recovery units are electrolytic units, metallic replacement units or ion exchange units wherein silver is exchanged for other ions. In the metallic replacement units, silver replaces iron or zinc, for example, in the solid state.

The fixer solution, usually sodium or ammonium thiosulfate, removes all of the unreactes ilver from the film. The fixer tank is located immediately after the developer tank. The developer causes the exposed silver to react. The fixer solution is periodically pumped from a fixer solution storage tank by a small metering pump to renew solution in the fixer tank for each film fed into the processor. This is done in an effort to maintain a substantially balanced concentration of fixer solution in the processor. Some of the developer solution from the developer tank is carried over into the fixer tank with the film and would soon completely dilute and neutralize the effectiveness of the fixer solution. An overflow is provided from the fixer tank to a silver recovery unit. Thus, as developer solution is carried into the fixer tank and as renewal solution is metered from the fixer storage tank, the fixer solution in the fixer tank overflows.

Whenever the fixer tank is emptied for periodic maintenance, such as cleaning of rollers and the like or for repair of any malfunctioning part or because of any imbalance of chemical in the fixer tank, those silver values in the solution are lost to the main drain. Also, in refilling an empty fixer tank the metering pump is not used since it is sized to maintain liquid levels and not to refill the tanks. Buckets are used to refill the fixer and developer tanks. Since the fixer tank is in very close proximity to the developer tank and the wash tank, both of which have open tops, refilling of the fixer tank must be very carefully done to prevent contamination of the developer solution or the wash water. As little as four ounces of fixer in a two to five gallon tank of developer inactivates the developer solution.

Another technique for silver recovery (not illustrated) involves an electrolytic unit wherein the overflow of solution from the fixer tank is continuously directed to an electrolytic silver recovery unit which removes silver from the solution and then returns the solution to the fixer tank. Whenever such a fixer tank is emptied for periodic maintenance or repair, the silver values in the tank are again lost to the sewer.

OBJECTS OF THE INVENTION

It is an object of the instant invention to provide a simplified, reliable system to enable more complete recovery of silver values from the fixer solution of an automated silver containing film processor.

A further object of the instant invention is to provide a silver recovery system which permits more frequent discharge of the fixer solution from the fixer solution tank.

Another object of the instant invention is to provide automated, rapid refilling means for refilling an empty fixer or developer tank.

A further object of the instant invention is to provide a regulated flow of silver containing fixer solution to a removable silver recovery unit during peak periods of use.

SUMMARY OF THE INVENTION

An improved system for recovery of silver values from automated film processing systems, particularly X-ray film processors, has been invented. The fixer tank is equipped with an overflow line and a bottom discharge line which are drained or pumped into a surge-drip tank. The surge-drip tank has an orifice to control the flow rate from the bottom of the surge-drip tank into a silver recovery unit, particularly a metallic replacement unit, to optimize silver extraction from the solution. The surge-drip tank is equipped with an overflow so that in the event more fixer solution comes into the tank than its volume will accommodate, the excess overflows into the silver recovery unit. The fixer tank is then refilled from the fixer storage tank by a high flow rate pump or by gravity flow if the storage tank for fixer solution is located at a higher elevation than the film processor tanks. For gravity feed systems, a large diameter refilling line is preferred while the replenishing line is preferably of a smaller diameter.

The system is very effective inasmuch as the surge-drip tank meters the rate of silver containing solution being introduced into the silver recovery unit, thus increasing the effectiveness of the silver recovery unit. The surge-drip tank is very effective for the purposes of the invention whenever the maximum discharge rate through the orifice does not exceed two gallons per hour and preferably is less than about one gallon per hour. Smaller rates such as one-half gallon per hour or less are particularly effective and can be advantageously used in processors having tanks of five gallons or less capacity wherein the usage is somewhat less than its maximum capacity. Also, since the fixer tank must be periodically maintained and occasionally repaired, requiring dumping of the tank contents, the system facilitates the recovery of all the silver values in the fixer tank rather than flushing the silver rich solution down a drain.

Dumping of the fixer solution is frequently required because of chemical imbalance of the solution. Also, the instant system permits the fixer tank to be periodically drained solely for the purpose of recovering the silver values to prevent silver from being carried over with the film and lost into the wash solution. In this regard, a silver concentration detector may be installed in the fixer tank so that the tank can be monitored and drained upon a certain concentration of silver being reached. Further description of the invention may be facilitated by reference to the attached drawings.

Figure 1:
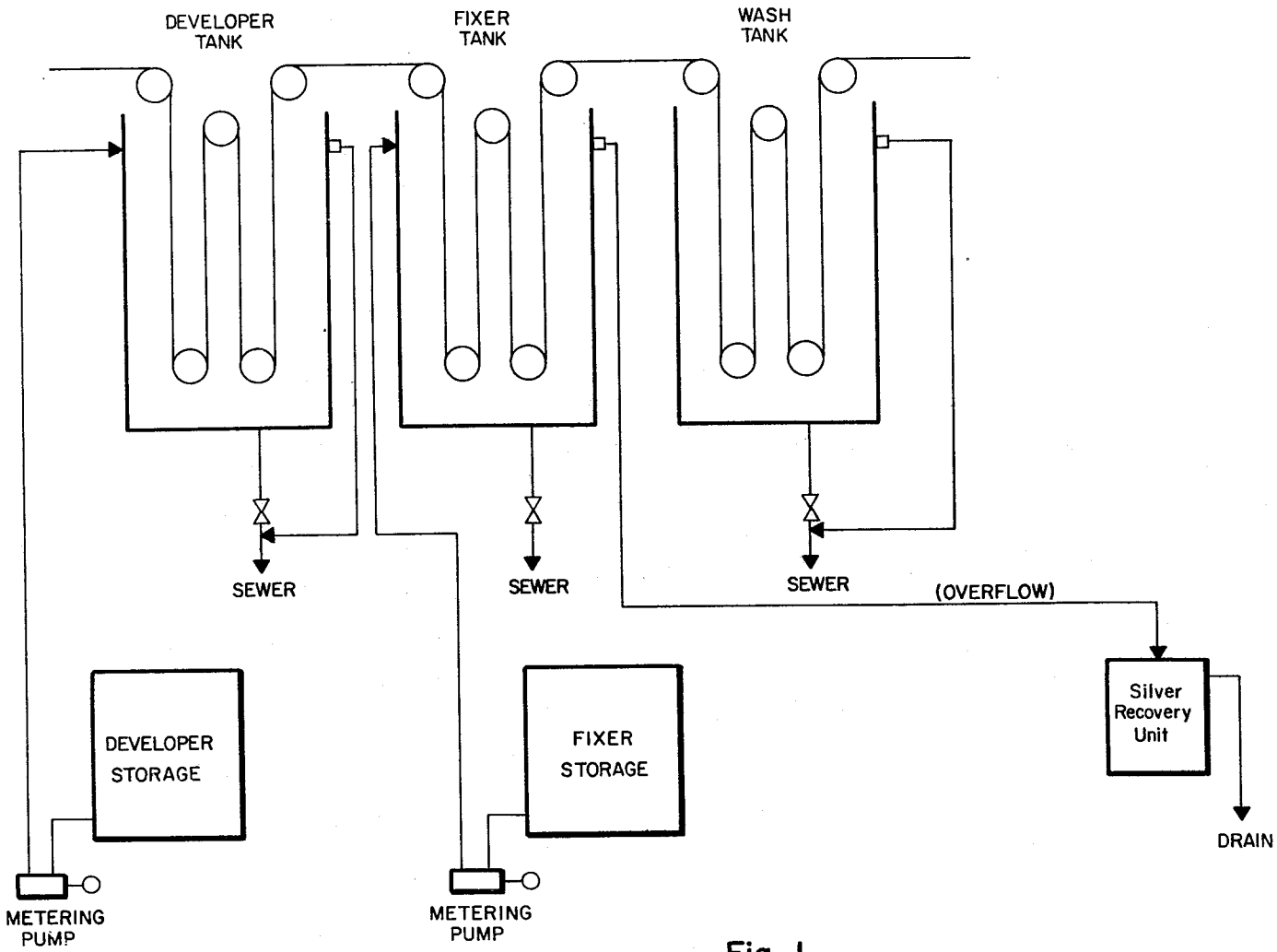
FIG. 1 illustrates a prior art system for silver recovery.
Figure 2:
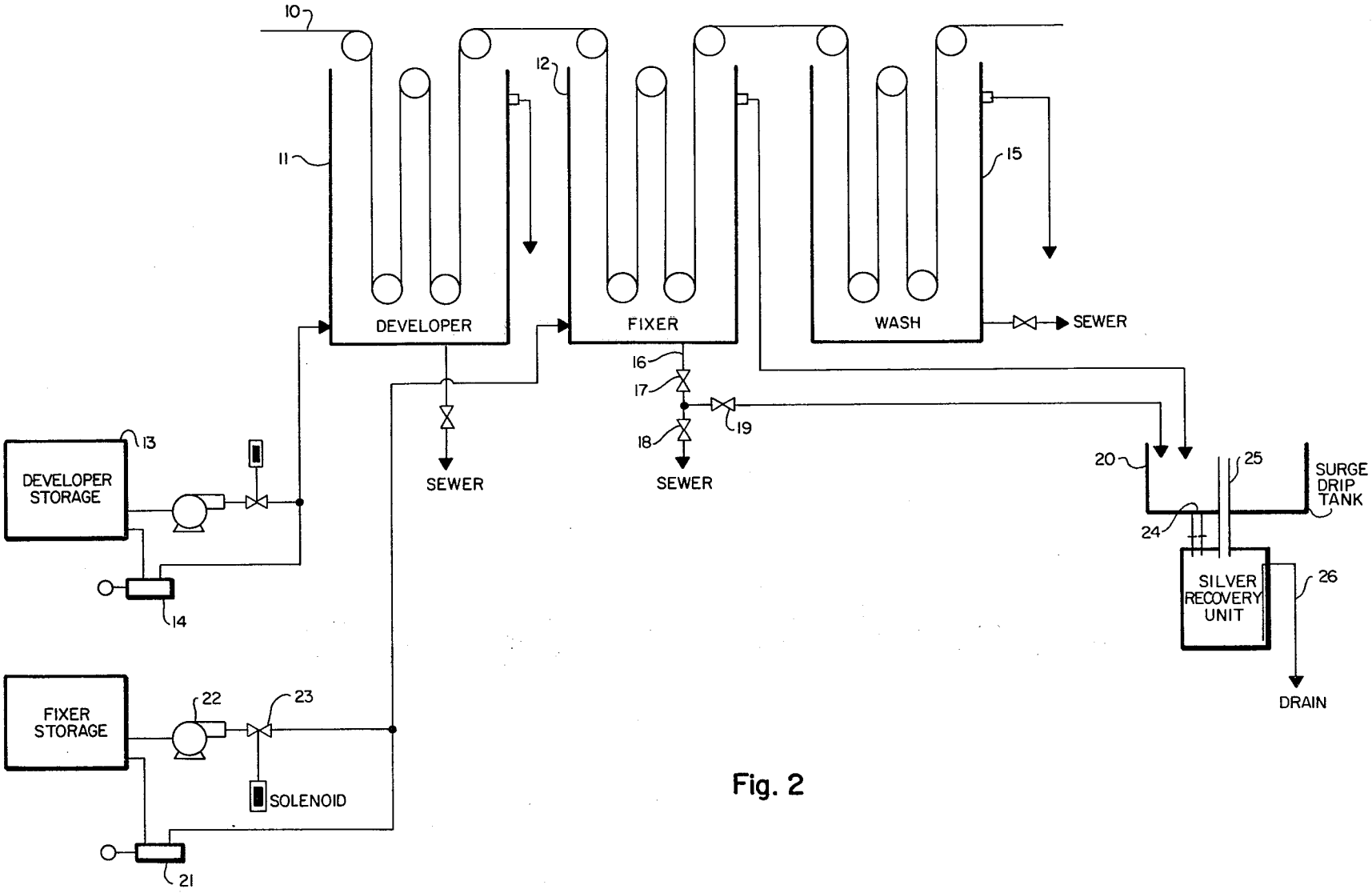
FIG. 2 is a flow diagram of an improved silver recovery system for X-ray film processors.

FIG. 2 illustrates an improved automated system for processing X-ray film and optimizing recovery of the silver removed from said film. The film 10 is continuously fed into a developer tank 11. The film 10 proceeds through the developer tank 11 at a predetermined rate so that the residence time is sufficient to develop the film properly. The film then proceeds into a fixer tank 12 wherein the reaction occurring within the development tank is then curtailed. Some developer solution is carried over with the X-ray film into the fixer tank, thus contaminating to some minor extent the fixer tank. The loss of developer fluid in the developer tank is made up from developer storage 13 by a metering pump 14 which periodically pumps a predetermined amount of developer solution into the tank. For a five gallon processor tank, about three ounces of fixer solution per 14"×17" film are pumped from storage to replenish the tank for solution lost and/or neutralized by carry-over developer solution. Any excess developer solution overflows the developer tank into the sewer. The film resides within the fixer tank for a predetermined time sufficient to remove substantially all the unreacted silver from the film and then is fed into a wash tank 15 where carry-over fixer is washed from the film. The film exits the wash tank to a dryer or other device. The film is then ready for viewing.

Most of the silver removed from the X-ray film resides in the fixer tank. As heretofore indicated, it has been common practice in recent years to equip the fixer tank overflow with a line leading to a removable silver recovery unit. In FIG. 2, the fixer tank is also equipped with a bottom discharge line 16 and valves 17, 18 and 19. The tank is drained by opening up valves 17 and 19 to drain the development solution to a surge-drip tank 20. If the fixer tank is flushed with water or other cleansing liquid the cleansing liquid may be drained to the sewer by closing valve 19 and opening valves 17 and 18. In normal operation while film is being processed through the fixer solution, all three valves 17, 18 and 19 are in a closed position.

Replenishing fixer solution is fed to the fixer tank by a metering pump 21. Whenever the fixer tank is drained for maintenance or repair or for periodic scheduled recovery of silver values, the fixer solution is pumped by a high rate pump 22 to refill the fixer tank. Solenoid valve 23 is interconnected with the film drive motor so that as long as the film processor is in an operating mode, solenoid valve 23 will not open and pump 22 cannot be actuated. The fixer refill pump 22 is sized to refill a typical processor fixer tank in a few minutes. Thus, a typical fixer refill pump has a pumping capacity of about one to two gallons per minute.

As fixer solution is collected in the surge-drip tank, either from the overflow or from the bottom discharge, it is then introduced into a silver recovery unit through an orifice opening 24 in the bottom of the surge-drip tank. The orifice regulates the rate at which solution is fed into the silver recovery unit to be commensurate with the silver extraction rate of the unit. In this way, the optimum operation of the silver recovery unit is ensured and very little silver value is lost through the drain from the silver recovery unit.

The surge-drip tank is designed to have a capacity at least as large as the fixer tank of one or more film processors so that the fixer solution may be drained completely into the surge-drip tank. An overflow standpipe 25 is provided whereby excess solution is drained into a silver recovery unit. Whenever a fixer tank is drained into the surge-drip tank, the overflow standpipe 25 allows overflow from the fixer tank caused by replenishing solution fed to the fixer tank to flow at a normal rate into the silver recovery unit. Thus, a film processor may be run immediately after the fixer tank is dumped (into the surge-drip tank) and refilled without the loss of any silver values. Since existing silver recovery units have been sized to handle the normal overflow of fixer solution caused by replenishment of solution in the fixer tank, the flow from the surge tank through the bottom orifice and the overflow standpipe does not overtax the unit nor create any substantial turbulence within the unit.

Typical removable silver recovery units collect some silver particles on the bottom of the unit during use. Draining the entire fixer solution from a processor fixer tank directly into the silver recovery unit would cause considerable turbulence within the unit and would cause silver particles from the bottom of the tank to become entrained in the solution and lost to the drain from the silver recovery unit. Thus, draining the fixer tank directly to the silver recovery unit would probably cause a net loss of silver. The loss of silver particles from the bottom of the tank would exceed the amount of silver recovered from the solution flowing rapidly through the tank. Furthermore, silver is considered by the EPA and by most manicipalities to be a toxic element in a sewage system. Silver is deemed as poisonous as mercury to animals and humans.

If desired, a second silver recovery unit could be placed in series with the first silver recovery unit so that the drain 26 coming from the first silver recovery unit is fed into a second silver recovery unit. In the event the first silver recovery unit is not removed or replaced on a timely basis, the silver values will still be collected. In utilizing two silver recovery units in series, a standard recommended procedure is to remove the first silver recovery unit on a predetermined schedule and replace it with the second silver recovery unit which is, in turn, replaced with a fresh silver recovery unit. Utilizing a pair of silver recovery units in series without a surge-drip tank would not be effective in recovering silver upon the draining of the fixer tank directly into the recovery units.

The invention illustrated in FIG. 2 is particularly effective inasmuch as the fixer tank must be periodically drained for routine maintenance or repair. Heretofore, the draining of the tank caused the loss of the silver, which often amounted to an ounce or more, which has a present market value in excess of $35.00 per ounce. In some larger operations, such dumping of the fixer tank may occur weekly, causing a substantial silver loss and introduction of toxic material, silver, into the sewage system. As heretofore indicated, it may be desirable to drain periodically the fixer tank solely for the purpose of recovering the silver values whether or not the unit requires maintenance. The system illustrated in FIG. 3 is designed to accomplish this purpose.

Figure 3:
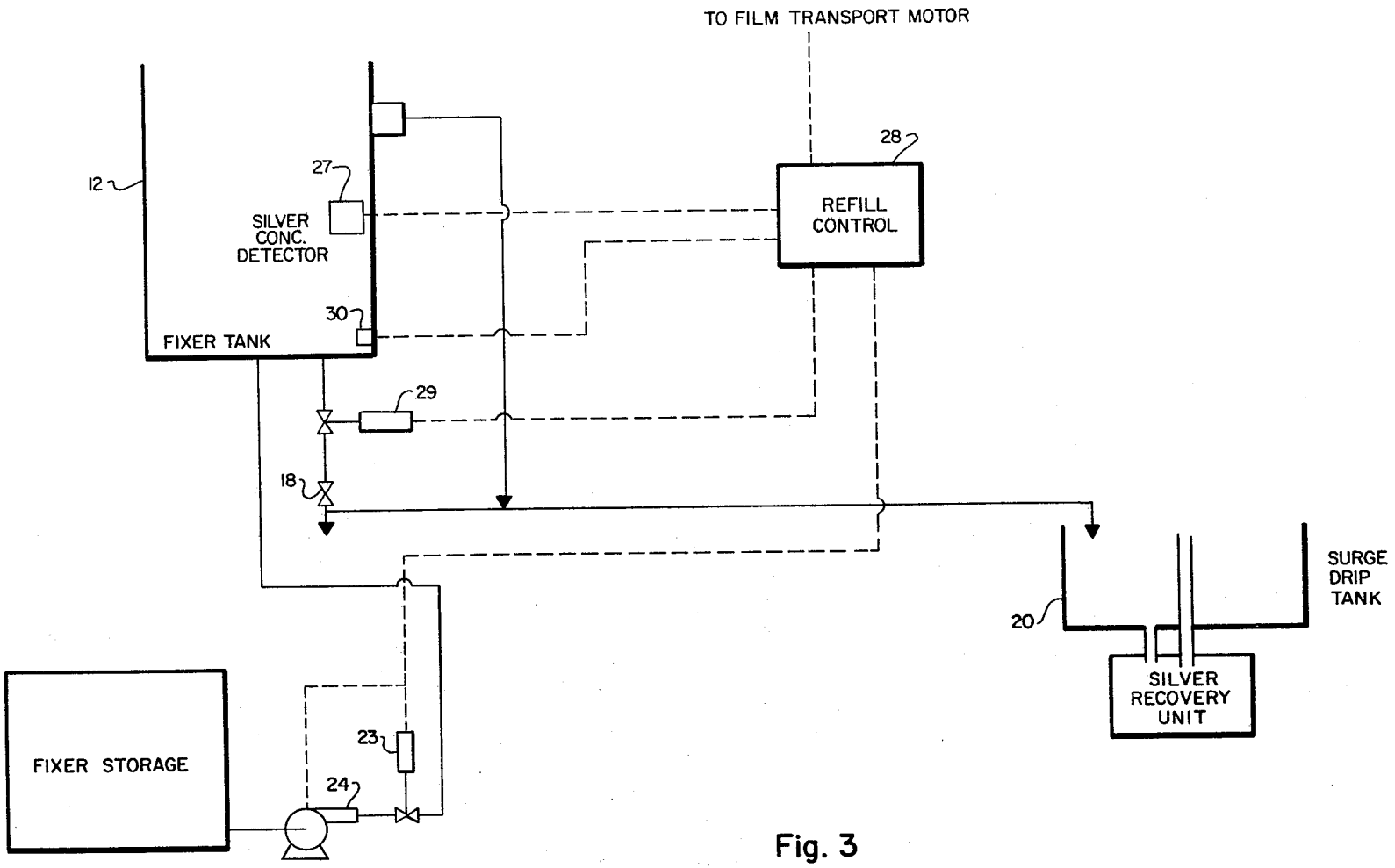
FIG. 3 illustrates a flow diagram for an automated silver recovery apparatus.

In FIG. 3 a fixer tank 12 is equipped with a silver concentration detector 27 which detects the concentration of silver present. The silver concentration detector may be preset so that upon a predetermined concentration of silver being attained, such concentration being below the concentration whereby much silver value would be lost by carry-over to the film wash tank, a refill control 28 actuates solenoid valve 29 to discharge the fixer tank into the surge-drip tank 20. Valve 18 is a manual valve and is maintained in a closed position. The refill control is interlocked with the film transport motor so that solenoid valve 29 is not operable while the film transport motor is operating.

In lieu of a silver concentration detector, a film counter may be utilized. The counter is preferably located at the feed end of the processor so that the film being fed into the processor breaks a light-beam at the film margins or contacts a micro-switch. The micro-switch or light-beam switch is connected to a counter which, after a preset number of film frames, e.g., 100, activates the draining and refilling of the fixer tank.

A liquid level sensor 30 is provided to inform the refill control 28 when the fixer tank is empty. Upon receipt of an empty signal, the refill control closes solenoid valve 29 and opens solenoid valve 23 and actuates pump 24 for a predetermined period of time sufficient to fill the fixer tank or, in the alternative, a liquid level control can be provided at the upper level of the tank which informs the refill control when the tank is full so that the refill control then closes solenoid valve 28 and turns off motor 24.

In a processor equipped with a silver concentration detector or a film counter, or on a predetermined dumping schedule for the fixer tank, the processing of 100 X-ray film frames of a size of about 14"×17" would result in about 300 ounces of replenishment fixer (about 2½ gallons) fed to the fixer tank. A like quantity of fixer overflows to the surge-drip tank. Refilling of the fixer tank after 100 film frames uses an additional five gallons of fixer. Thus, on such a schedule, about 7½ gallons of fixer flows into the surge-drip tank. In a surge-drip tank discharging about one gallon per hour of solution into the silver recovery unit about eight gallons of solution can be handled in eight hours. Thus, in a processor receiving fairly heavy use, such as processing 100 film frames having a size of 14"×17" per eight hour shift, the fixer tank could be dumped at the end of each shift so that fresh fixer solution would be available in the processor fixer tank at the beginning of each work shift.

A particular advantage of the instant invention resides in the regulation of flow of silver-containing fixer solution to a silver recovery unit. Typical silver recovery units of the metallic replacement type, such as those wherein silver replaces iron in steel wool, perform best when a constant flow of liquid is introduced. The surge-drip tank provides a substantially uniform flow of silver-containing liquid to the silver recovery unit to enhance recovery of the silver within such solutions.

The system permits frequent dumping of silver-bearing fixer solution to eliminate substantially the carry-over of silver into the wash tank and the consequent introduction of a toxic element in the sewage system. Also, more frequent dumping of the fixer solution provides more effective fixing of the film.

Although the description of the invention has dealt primarily with automated film processors of the type used for X-ray films, the invention is equally effective for any type of processor or tray system.

I claim:

1. An automated film processor having individual developer, fixer and washer containers and with means for continuously transporting x-ray film through said tanks serially and associated with a removeable silver recovery unit comprising:

overflow means on said fixer container;

bottom discharge means on said fixer container;

a surge-drip tank having a capacity at least as large as said fixer container, said surge-drip tank having a lower discharge orifice sized to discharge liquid at a slow flow rate and an upper overflow port, said overflow port and said discharge orifice positioned to drain liquid into said removeable silver recovery unit;

overflow conduit means connecting said fixer container overflow with surge-drip tank;

developer automatic refill means connected to said developer container;

fixer automatic refill means connected to said fixer container.

2. The processor of claim 1 wherein said bottom discharge means has valve means to direct liquid to said surge-drip tank or to a main drain.

3. The processor of claim 1 wherein said fixer automatic refill means comprises a silver concentration detector in said fixer processing tank, valve means and pump means actuatable by said silver concentration detector, said valve means and pump means connected to a fixer storage tank.

4. The processor of claim 1 wherein said surge-drip tank has said discharge orifice in the bottom of said surge-drip tank and said overflow port located near the top of said surge-drip tank.

5. The processor of claim 1 wherein said surge-drip tank has a capacity of at least five gallons.

6. The processor of claim 1 wherein said fixer automatic refill means comprises a pump having a capacity of at least about one gallon per minute.

7. The processor of claim 1 wherein said surge-drip tank discharges liquid through its orifice at a maximum rate of about one gallon per hour.

8. The processor of claim 1 wherein said fixer automatic refill means comprises a film counter, valve means and pump means actuatable by said film counter, said valve and pump means connected to a fixer storage tank.

9. In an automated film processor having individual developer, fixer and washer tanks and means for continuously transporting film therethrough in series, wherein said fixer tank has an overflow line and a bottom discharge line, and wherein said fixer tank communicates with a silver recovery unit, the improvement comprising:

interconnection means to interconnect the overflow line and bottom discharge line of the fixer tank to a surge-drip tank, said bottom discharge line having a valve therein;

a surge-drip tank having a capacity at least as large as said developer tank and a lower orifice sized to discharge liquid at a relatively slow rate and overflow means, said overflow means and orifice located to enable liquids to drain into said silver recovery unit.

* * * * *